US008893757B2

(12) United States Patent
Gmeiner et al.

(10) Patent No.: US 8,893,757 B2
(45) Date of Patent: Nov. 25, 2014

(54) APPARATUS FOR APPLYING LABELS TO CONTAINERS

(75) Inventors: Franz Gmeiner, Sinzing Ortseil Eilsbrunn (DE); Heinz Humele, Thalmassing (DE)

(73) Assignee: Krones AG (DE)

( * ) Notice: Subject to any disclaimer, the term of this patent is extended or adjusted under 35 U.S.C. 154(b) by 199 days.

(21) Appl. No.: 12/358,475

(22) Filed: Jan. 23, 2009

(65) Prior Publication Data

US 2009/0188629 A1 Jul. 30, 2009

(30) Foreign Application Priority Data

Jan. 25, 2008 (DE) ..... 10 2008 006 107

(51) Int. Cl.

| | |
|---|---|
| ***B27G 11/02*** | (2006.01) |
| ***B29C 65/02*** | (2006.01) |
| ***B31F 5/04*** | (2006.01) |
| ***B32B 37/00*** | (2006.01) |
| ***B29C 65/00*** | (2006.01) |
| ***G05G 15/00*** | (2006.01) |
| ***B32B 38/04*** | (2006.01) |
| ***B65C 3/16*** | (2006.01) |
| ***B65C 9/18*** | (2006.01) |
| ***B65C 9/24*** | (2006.01) |

(52) U.S. Cl.

CPC ..... *B65C 3/163* (2013.01); *B65C 9/1819* (2013.01); *B65C 9/24* (2013.01); *B65C 2009/1846* (2013.01)

USPC ..... 156/379.6; 156/349; 156/272.2; 156/272.8

(58) Field of Classification Search

CPC ..... B65C 3/00; B65C 3/06; B65C 3/08; B65C 3/065; B65C 3/12; B65C 3/16; B65C 3/163; B65C 9/02; B65C 9/04; B65C 9/08; B65C 9/18; B65C 9/1803; B65C 9/1807; B65C 9/30; B65C 9/32; B65C 2009/1834

USPC ..... 156/379.6, 349, 272

See application file for complete search history.

(56) References Cited

U.S. PATENT DOCUMENTS 4,250,798 A * 2/1981 Yamato et al. ..... 493/306
4,632,721 A 12/1986 Hoffmann et al.

(Continued)

FOREIGN PATENT DOCUMENTS

DE 26 04 155 8/1976
DE 26 04 215 8/1976

(Continued)

OTHER PUBLICATIONS

Official Action received in Applicants' corresponding EPO Application Serial No. EP 09151209.

*Primary Examiner* — Richard Crispino
*Assistant Examiner* — Matthew Hoover
(74) *Attorney, Agent, or Firm* — Hayes Soloway, P.C.

(57) ABSTRACT

An apparatus for applying labels to containers is provided. In one embodiment, the process of applying the labels to the container is carried out by means of a laser unit. In another embodiment, a cutting unit is provided for the apparatus, which cutting unit likewise uses a laser and is arranged at least partially inside a cutting roller. In preferred embodiments, the complete application process, i.e. in particular including the bonding of the end sections of the label, is carried out by means of the laser unit.

17 Claims, 3 Drawing Sheets

(56) References Cited

U.S. PATENT DOCUMENTS

| | | | | |
|---|---|---|---|---|
| 5,464,495 | A | 11/1995 | Eder | |
| 5,741,381 | A * | 4/1998 | Dolence et al. | 156/64 |
| 2002/0029856 | A1 | 3/2002 | Gonzalo | |
| 2007/0056679 | A1 * | 3/2007 | Orlandi et al. | 156/217 |

FOREIGN PATENT DOCUMENTS

| | | | |
|---|---|---|---|
| DE | 33 14 263 | 1/1984 | |
| DE | 197 16 079 | 4/1998 | |
| DE | 19921843 | 11/2000 | B65C 9/18 |
| DE | 100 64 618 | 7/2002 | |
| DE | 697 31 115 | 10/2005 | |
| DE | 299 24 839 | 1/2006 | |
| EP | 0 095 882 | 12/1983 | |
| EP | 1400455 | 3/2004 | B65C 9/18 |
| EP | 1 715 468 | 10/2006 | |
| WO | WO 00/37344 | 6/2000 | |
| WO | WO 2007/031502 | 3/2007 | |
| WO | WO 2007/110738 | 4/2007 | |
| WO | WO 2007/110738 | 10/2007 | B65C 9/18 |
| WO | WO 2007/148189 | 12/2007 | B65C 3/06 |

* cited by examiner

APPARATUS FOR APPLYING LABELS TO CONTAINERS

The present invention relates to an apparatus for applying labels to containers and also to a method for applying labels to containers. Such apparatuses and methods are known from the prior art. These apparatuses usually comprise a cutting unit which cuts individual, precisely adapted labels from an endless strip of labels. These labels or the rear side thereof are then coated with an adhesive and finally the labels are applied to the relevant container. This process usually requires a plurality of rollers, on which the labels and label strips are guided so that they can ultimately be applied to the container.

The cutting units usually have in the prior art a cutting blade which cooperates with a cutting channel in order to accurately cut the label.

WO 2007/110738 A1 discloses an apparatus for producing labels. In this apparatus, a cutting means is provided which cuts labels from a plastic film, wherein the cutting means comprises a laser.

This apparatus also comprises a distributing roll for an adhesive, in order to apply the adhesive to the labels.

US 2002/0029856 A1 discloses a labelling apparatus. This labelling apparatus comprises a cutting drum, and also cutting means which are arranged on this cutting drum.

U.S. Pat. No. 4,632,721 describes an apparatus for arranging labels on containers. In this apparatus, cutting blades are arranged on a cutting drum, which cutting blades cooperate with a further cutting element which is provided adjacent to this drum.

WO 2007/031502 discloses an apparatus for producing shrink-fit sleeve labels, wherein end regions of these label sections are bonded to one another by means of a laser.

WO 2007/148189 discloses a further apparatus for producing shrink-fit sleeve labels. Here, a generating device for an electrostatic charge is provided, which electrostatically charges regions of labels.

U.S. Pat. No. 5,464,495 describes a method and an apparatus for applying labels to containers. This apparatus comprises heating devices which bond end sections of the labels to one another.

EP 095882 A2 discloses a method and an apparatus for arranging labels made from a shrink-fit material. Here, too, a heat source is used for applying the labels to the containers.

The object of the present invention is to provide an apparatus for applying labels, which apparatus can be produced with lower costs. In particular, the intention is to provide a labelling apparatus which can be used without adhesives and also without corresponding rollers for applying adhesive. In addition, the object of the present invention is to provide an apparatus and a method for applying labels to containers, which allows reduced wear compared to the prior art.

An apparatus according to the invention for applying labels to containers comprises a cutting unit which cuts labels from a label strip. Also provided is an application unit which is arranged downstream relative to the cutting unit and which applies to the containers the labels cut by the cutting unit. According to the invention, the application unit comprises a radiation device, wherein this radiation device is configured in such a way that the radiation emitted by the radiation device applies the labels to the containers.

Preferably, the radiation device comprises a laser light source. In contrast to the prior art, therefore, a laser light source is used in particular also for applying the labels to the containers. In this way, it is possible to eliminate the need for adhesives and also the adhesive rollers which are complicated in the prior art.

Preferably, the application unit comprises a carrier device which transports the containers on a path in the shape of a segment of a circle. A transport carousel is thus preferably provided, on which the containers are guided along said path in the shape of a segment of a circle. Furthermore, the application unit preferably comprises a plurality of support elements for the containers, wherein these support elements are arranged such that they can rotate relative to the carrier device. With one preferred apparatus, therefore, not only are the containers guided along the path in the shape of a segment of a circle, but rather the containers are also preferably rotated about their own axis, in order in this way to be equipped with the labels.

Preferably, the radiation device is configured in such a way that a first section of the labels is bonded to an outer wall of the container by the radiation emitted by the radiation device. A section of the labels is thus arranged on the outer wall of the container by means of laser welding for example. Furthermore, the radiation device is preferably configured in such a way that a first section of the labels is bonded to a second section of the labels by the radiation emitted by the radiation device. In this preferred embodiment, therefore, a radiation device is used not only to apply the labels to the containers but also to bond the two end sections. There is thus no need for adhesive throughout the entire application process, and a laser device is preferably used both to arrange the labels on the bottle and also to bond the two end sections of the labels to one another.

In a further advantageous embodiment, the radiation device is configured in such a way that a first section of the labels is bonded to an outer wall of the container and the first section of the labels is bonded to a second section of the labels by the radiation emitted by the radiation device. The same radiation device is thus used for the entire application process.

In a further advantageous embodiment, the application unit comprises a radiation deflecting device which changes an impingement region where the radiation coming from the radiation device impinges on the label. More specifically, it would be possible to adapt a laser beam to the movement of the container and thus to convey it along therewith in such a way that the label is as a result welded to the container along a vertical line for example by laser spots.

In a further advantageous embodiment, the apparatus comprises a guide device which guides a cut label during the process of applying it to the container. A first end section for example is thus firstly welded to the container and, in order to prevent the label from slipping relative to the container, use is made of the guide device which stabilises the label in a predefined position relative to the container. The guide device preferably has through-openings, which allow the passage of the radiation emitted by the radiation device. In this case, these through-openings extend for example in the guide direction of the labels, so that the laser beam can pass through these through-openings and can bond the two end sections of the label to one another.

Preferably, the guide device is arranged in such a way that it arranges or presses the label onto the container.

However, in another advantageous embodiment, it would also be possible that the guide device is made from a material which is transparent to the radiation emitted by the radiation device. In this case, the laser radiation is not absorbed by the guide device but rather passes preferably essentially without any attenuation through the latter in order to bond together the end sections of the label strips arranged therebehind. Depending on the spectral range of the laser radiation, different materials may be considered for this.

Preferably, the cutting unit also comprises a radiation source for cutting the labels. In this way, lasers are used with particular preference both for cutting the labels and also for the complete application process. In this way, the production costs of such a system can be considerably reduced.

In a further advantageous embodiment, the cutting unit comprises a rotatable roller for guiding the label strip, wherein this rotatable roller has fixing means for fixing the label strip at least temporarily to a circumferential wall of the roller. These fixing means may be for example openings which are acted upon by a vacuum in order to adhere the label strips at least temporarily to the roller.

In a further advantageous embodiment, the cutting unit has a guide plate for guiding the label strip, which guide plate is arranged in a stationary manner and adjacent to the roller. This guide plate is therefore arranged in a fixed position in space, and the roller rotates relative thereto. By virtue of the guide plate, it is possible to guide the label strip in a precisely predefined manner during the actual cutting process.

The guide plate preferably has a cutout, through which the label strip can be temporarily fixed to the roller. More specifically, the roller can make contact with the label strip through this cutout and can draw it towards it by virtue of said vacuum openings.

The present invention also relates to an application unit for applying labels to a container, wherein this application unit comprises a carrier device, on which a plurality of support elements for the containers are arranged, wherein these support elements on the carrier device can be moved along a predefined path, and wherein these support elements are arranged such that they can rotate relative to the carrier device.

The application unit preferably comprises a radiation device, wherein this radiation device is configured in such a way that the radiation emitted by the radiation device applies the labels to the containers. Also in this application unit according to the invention, therefore, the radiation device in the form of laser is used in order to apply the labels to the containers.

The present invention also relates to a cutting unit for cutting labels from a label strip, wherein the cutting unit comprises a rotatable roller, and wherein this rotatable roller has fixing means for fixing the label strip at least temporarily to a circumferential wall of the roller. Also provided is a radiation device which directs radiation onto the label strip in order to cut the labels.

According to the invention, a beam path of a beam passing from the radiation device to the label strip runs at least partially inside the circumferential wall of the rotatable roller, or more specifically inside the inner surface of this circumferential wall. Preferably, the radiation device comprises a laser source which is arranged in a stationary manner and in particular in a stationary manner relative to this roller.

In a further advantageous embodiment, the roller has in its interior a deflecting element for the radiation emitted by the radiation device. In this case, it is possible for example that the laser radiation is emitted onto the deflecting element from above essentially along a rotation axis of the roller (or parallel thereto), and from there (from inside) passes to the labels.

In a further advantageous embodiment, it is possible to select the deflecting element from a group of deflecting elements which includes prisms, mirrors and the like. However, other elements which reflect or deflect the light would also be possible.

In a further advantageous embodiment, the circumferential wall has gaps running in a direction of the rotation axis of the roller. Through these gaps, the laser light can pass outwards through the circumferential wall and thus can impinge on the labels to be cut. Preferably, these gaps are longer than the label to be cut.

In a further advantageous embodiment, the deflecting element is arranged in a fixed position. This means that the deflecting element, which is designed for example as a mirror, rotates with the roller.

In a further advantageous embodiment, the deflecting element is arranged such that it can pivot about at least one pivot axis. By virtue of this pivotable arrangement, the laser beam can be directed in the longitudinal direction of said gap onto the labels and can thus trigger a cutting process.

The present invention also relates to a method for applying a label to containers, wherein the container is rotated on a support element during the application of the label. According to the invention, in order to apply the label to the container, use is made of a laser unit which directs laser light onto the label to be applied in order to apply the label. By means of this laser light, the labels are fixed to the containers.

Preferably, the laser unit firstly bonds a first section of the label to the container and then bonds this first section to a further section of the label. With particular advantage, these sections are end sections of the label.

Preferably, the label is cut from a label strip by means of a further radiation device, which is in particular also a laser. In this preferred variant, therefore, lasers are used both to cut the labels and also to apply the latter to the containers. By using lasers for the whole process, the costs of producing labelled containers can particularly advantageously be reduced.

Preferably, the label strip is guided on a rotatable roller during the cutting process. In a further advantageous embodiment, the label is transferred from the rotatable roller via a guide plate directly to the container. In this preferred variant, therefore, it is proposed to provide no further rollers for transfer purposes and in particular also no such rollers which serve for applying adhesive to the labels.

In a further preferred method, the label strip is guided relative to the container by means of a guide device during application to the container. With particular preference, the label strip is firstly arranged on and fixed to the container at one end section and then is guided by means of the guide device in order finally to bond the second end section to the first end section likewise by laser welding.

Further advantages and embodiments will emerge from the appended drawings:

Figure 1:
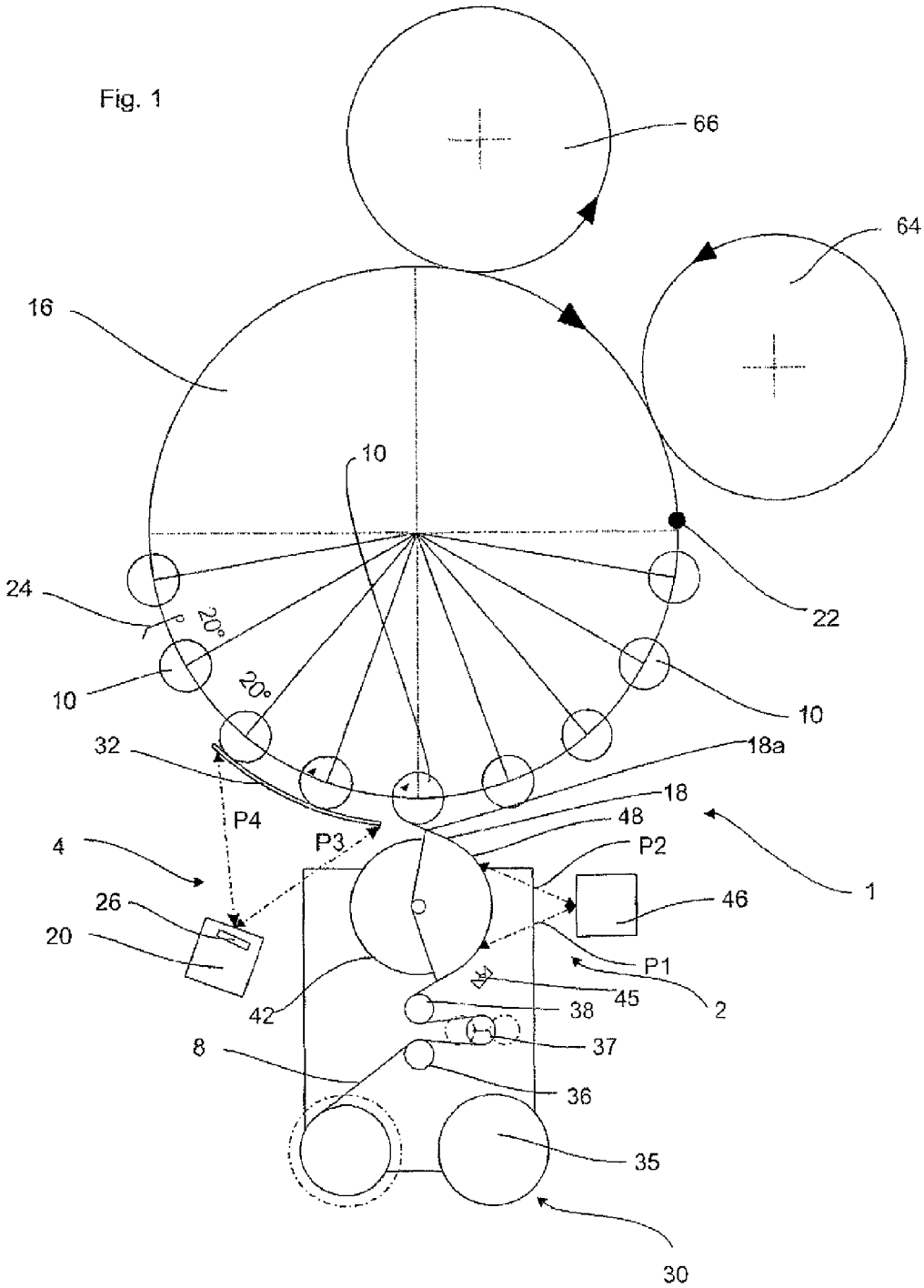
FIG. 1 shows an apparatus according to the invention for applying labels to containers.

FIG. 1 shows an overall view of an apparatus 1 according to the invention for applying labels to containers. Here, the containers to be labelled are transferred via an inlet star wheel 64 to a carrier device 16. On this carrier device 16, the containers are clamped between the actual carrier device 16 and a centring bell (not shown) on the bottle table. A plurality of support elements or container supports are provided, wherein these support elements 22 are driven individually preferably by means of servo motors and can carry out essentially any desired rotations relative to the carrier device 16, said rotations being adapted to the bottle diameter and the label length. After they have passed through the carrier device, the containers are conveyed away via an outlet star wheel 66.

Reference 30 denotes in its entirety a dispensing device for labels. Label rolls 35 are provided, wherein these are arranged on carriers which have a dedicated servo drive. A roller system consisting of two rollers 36 and 38 and at least one dancer roller 37 feeds the label strip 8 to a cutting unit 2. This cutting unit 2 comprises a rotatable roller 42 which serves for transporting the label strip 8, in particular during the cutting process. A guide plate 48 in the form of a slide plate 48 which will be explained in more detail below is provided around the outer circumference of this rotatable roller. This guide plate has a cutout, through which the roller 42, which is designed as a vacuum transport wheel, makes contact over part of its circumference with the label strip 8 and can thus transport the latter. The circumferential speed of this roller 42 preferably corresponds to the label length per cycle time.

Reference 46 denotes a radiation device, such as in particular a laser, which is used to cut the label strip 8 into labels 18. The radiation device 46 has deflecting means which allow a change in position of the laser light emitted along the arrows P1 and P2. More specifically, mirrors or scanning elements are provided which move the impingement point of the laser light on the roller 42 and thus also on the label strip 18 with the movement of the label strip. By virtue of this preferably synchronised movement, vertical cuts of the label strip can be achieved.

Reference 45 denotes a marking detection which detects markings on the label strip. Based on this marking detection, it is possible to control a laser scanner (not shown), by means of which the label strip 8 is cut during the constant advance movement. The speed and the position of the pressure and cutting pattern is controlled by the marking detection 45.

After the cutting process, the labels thus cut are stuck onto the containers 10. As soon as a corresponding section 18*a* of a label strip meets the container 10, it is stuck onto the container by means of a further radiation device 20, which is likewise a laser, wherein this sticking preferably takes place by means of spot welding. This sticking preferably takes place by means of only a few spot welds.

Reference 22 denotes a radiation deflecting device such as a scanner for example. By means of this radiation deflecting device, it is possible on the one hand, as also explained with reference to the cutting process, for a vertically running welding line to be generated if the beam is carried along with the movement of the labels and containers 10. On the other hand, this radiation deflecting device also means that the beam coming from the radiation device can be used both for sticking the section 18*a* to the container 10 (arrow 3) and for bonding the two end sections 18*a*, 18*b* of the label 18 (arrow P4).

To this end, firstly the first end section 18*a* is arranged on the container 10 and then the radiation device is pivoted in such a way that the two end sections 18*a*, 18*b* can be bonded to one another. It would also be conceivable that the laser 20 in FIG. 1 welds the first section 18*a* to the container 10 during a downward movement and then welds the two sections 18*a*, 18*b* to one another during an upward movement. The reverse procedure would also be conceivable.

Preferably, the circumferential speed of the containers 10 in this region corresponds precisely to the transport speed of the labels 18.

Once the section 18*a* has been stuck onto the container, the intrinsic rotation of the container and of the support element 22 is accelerated in order in this way to create a distance from a further film section 18*a* for the transfer thereof. Reference 32 denotes a guide device (also referred to as a rolling board) which guides the label strip 18 during the process of applying it to the container. In an end region of this guide device 32, an overlapping of the two end sections of the label occurs. These two end sections are likewise welded together using the radiation device 20. This process will be explained in more detail with reference to FIGS. 3 and 4.

Figure 2:
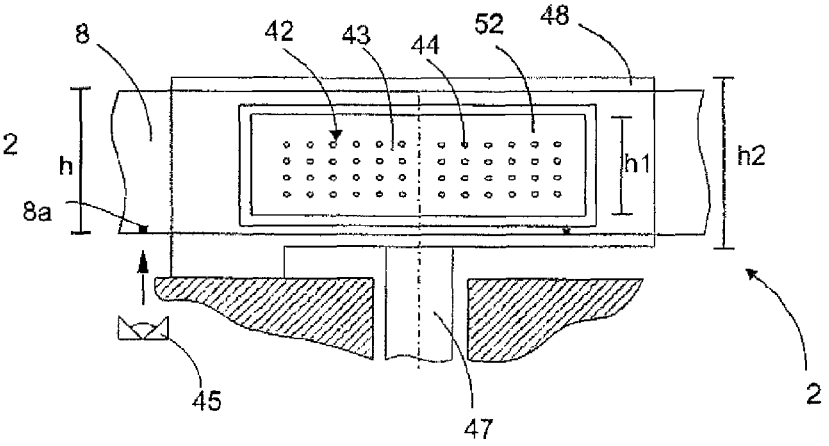
FIG. 2 shows a partial view of a cutting unit for the apparatus of FIG. 1.

FIG. 2 shows a detailed view of the cutting unit shown in FIG. 1. It is once again possible to see here the guide plate, denoted in its entirety as 48, which is arranged in a fixed position and relative to which the roller 42 rotates. This roller 42 has a circumferential wall 43, on the surface of which a plurality of fixing elements in the form of suction holes are provided. The purpose of the cutout 52 (which is of rectangular shape here) is that the label strip 48 can be drawn through this cutout by the roller 42 or the individual fixing elements 44 and in this way can be transported.

Here too, reference 45 denotes the marking detection explained with reference to FIG. 1 for detecting markings 8*a* on the label strip. It can be seen that the label has a height h which is greater than the height h1 of the cutout 52 but smaller than the height h2 of the guide plate 48. In this way, this guide plate 48 serves as a slide plate on which the label strip 8 is constantly guided, i.e. including in the region of the cutout 52. Reference 57 denotes a drive shaft for driving the roller 42. The label is cut along its entire height, i.e. including in the region in which the guide plate is located below the label 8.

Figure 3:
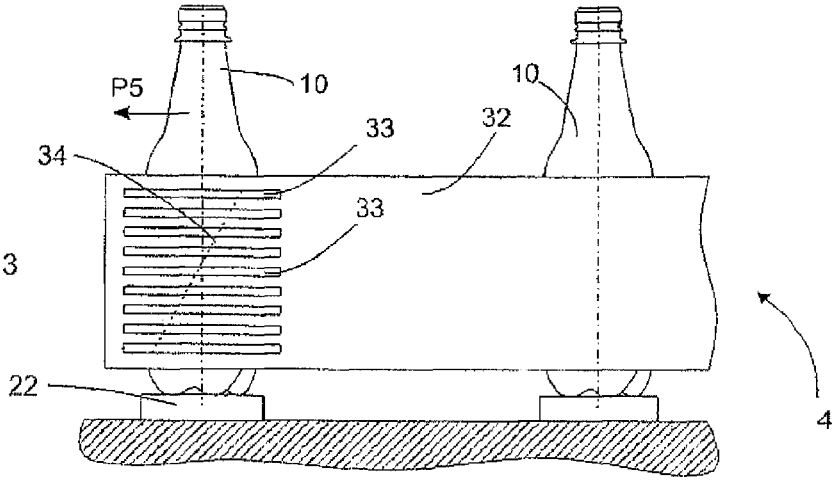
FIG. 3 shows a partial view of an application unit for the apparatus of FIG. 1.

FIG. 3 shows a detailed view of the application unit 4. It is once again possible to see here the guide device 32, which in its left-hand sub-region has through-slots 33. Through these through-slots, the laser spots can be used to stick together the end sections of the labels 18 (not shown). In FIG. 3, the container 10 to be labelled is guided along the guide plate 32 during the entire process of applying the label, wherein the arrow P5 indicates the transport direction. Reference 22 denotes the support element, by means of which the container is rotated. It is possible to see here a diagonal line 34, along which the laser spots impinge. The inclination of this line is adapted to the rotational speed of the containers, so that a vertical weld seam or weld line is produced as a result. Through the through-slots, therefore, a close succession of spot welds is produced in order to stick together the end sections of the label.

Figure 4:
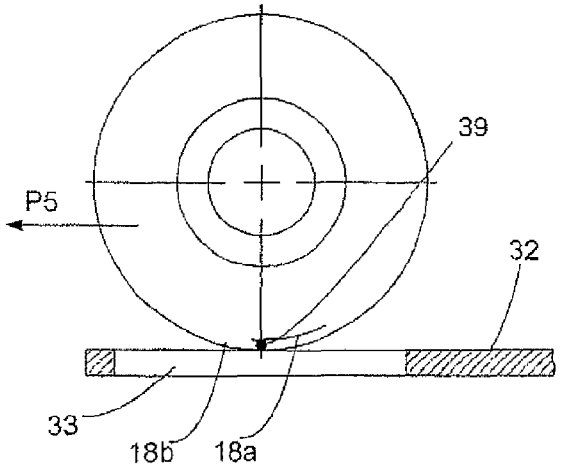
FIG. 4 shows a view to illustrate an application process.

FIG. 4 shows a plan view to illustrate the welding process. It is possible to see here the two end sections 18*a* and 18*b* of the label 18, which are welded to one another by means of a spot weld 39. Here too, reference 33 denotes a through-opening of the guide device 32.

The guide device 32 thus serves for arranging the label on the container in a smooth manner, i.e. without any warping.

Figure 5:
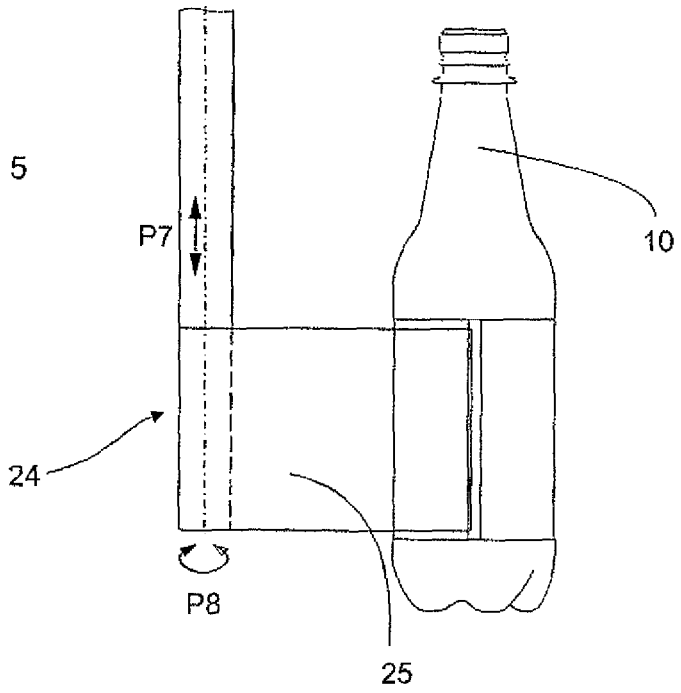
FIG. 5 shows an alternative embodiment of part of an application unit.

FIG. 5 shows a further embodiment, by means of which the labels can be applied to the containers. Here, a continuous weld seam is used and a plurality of smoothing devices 24 (also shown in FIG. 1) are used which smooth onto the container the label which has already been applied to the container. More specifically, one smoothing device 24 is assigned here to each support element or each container. Preferably, the individual smoothing devices 24 move along with the respective containers.

These smoothing devices are mechanically controlled and can preferably be displaced in the direction of the arrow P7 and also rotated in the direction of the double arrow P8. The displaceability in the direction of the arrow P7 serves to avoid collisions with other elements. A smoothing body 25 of the smoothing device 24 may be heated or equipped with a heating element. Preferably, however, the end sections of the label are stuck together here by means of a linear seam, wherein preferably this linear seam is applied next to the smoothing body. In this case, too, the radiation device 20 is used to produce the linear seam.

Figure 6:
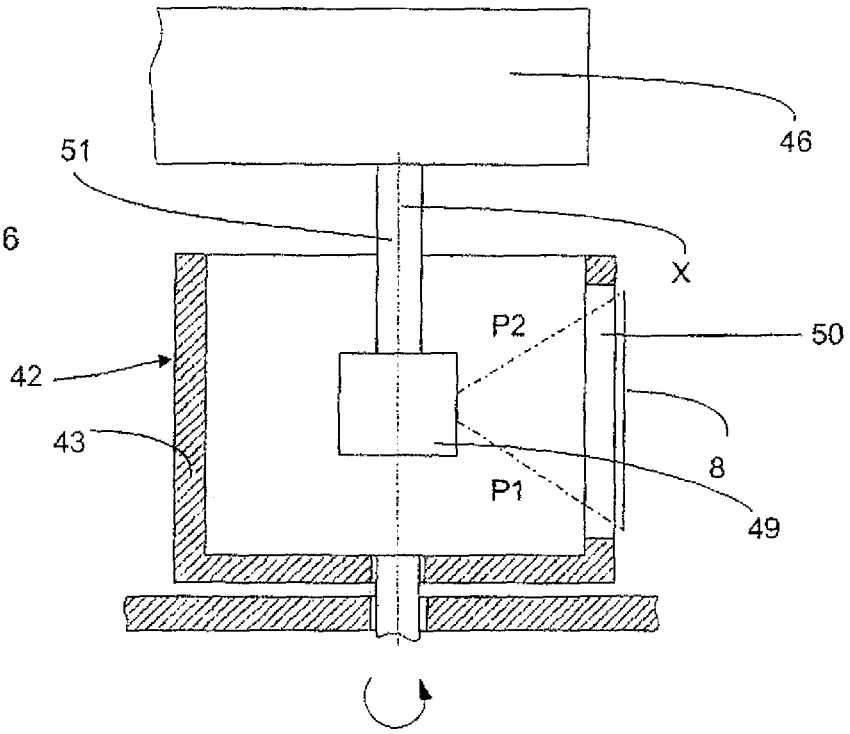
FIG. 6 shows a diagram of a further cutting unit according to the invention.

FIG. 6 shows a further embodiment of a cutting unit according to the invention. In contrast to the embodiment shown in FIG. 1, in which the label strip is cut from outside, here a cutting of the label strip 8 takes place from inside. For this purpose, a stationary radiation device 46 in the form of a laser is provided, which is preferably arranged in the centre of the cutting roller 42. More specifically, a deflecting element 49 or a scanning head of this laser is arranged in a fixed position in the centre of the cutting roller 42 via a holder 51, through which the laser beam can also be guided. However, it would also be possible to arrange this scanning head in an offset manner (or eccentrically) relative to the rotation axis X. Arranged in the circumferential wall 43 of the cutting roller 42 are through-openings 50 or slots, through which the radiation coming in the direction of the arrows P1 and P2 can cut the label strips 8. In a further embodiment, it would also be conceivable to integrate the complete radiation device 46 in the cutting roller 42. It would also be possible to provide a plurality of fibreoptic elements which are guided directly from the laser 46 to the gaps 50 and cut the labels directly there. For example, such optical fibres such as glass fibres could either be rotated with the cutting roller 42 or be arranged in a fixed position, and could cut the labels in each case at the correct point in time.

For example, it would be possible to provide a displacement device, such as a carriage, which displaces ends of glass fibres relative to the longitudinal directions of the through-openings, in order in this way to cut the labels. For instance, it would be possible to provide a bundle of glass fibres, wherein one end of this bundle is preferably arranged symmetrically relative to the rotation axis and the light of one or more lasers is coupled into this end. This bundle preferably rotates with the cutting roller 42 but is supplied from a stationary laser. At the other end of this fibreoptic bundle, a lens may be provided which focuses the light emerging from the optical fibres onto the label to be cut.

It would also be possible to design the deflecting element 49 as a mirror which is arranged in the centre of the cutting roller 42 and which is rotated with the cutting roller at the time at which the label is cut and then returns to a rest position. In this case, it would be possible to provide suitable carrier elements on the roller, which carry the mirror in certain rotary positions. Guide cams could also be provided which pivot or tilt the mirror while it is being carried so that the label strip is cut along the height h.

All of the features disclosed in the application documents are claimed as essential to the invention in so far as they are novel individually or in combination with respect to the prior art.

The invention claimed is:

1. An apparatus for applying labels directly to bottles as the bottles are moved along a transport path, comprising a cutting unit arranged to cut labels from a label strip, and an application unit arranged downstream relative to the cutting unit for applying labels cut by the cutting unit to the moving bottles, wherein the application unit comprises a laser radiation device which includes a controller which is suitable for controlling the radiation device so that laser radiation emitted by the laser radiation device is directed toward the transport path of the bottles being labeled, and is of sufficient power such that a first end of a cut label can be welded directly to an outer wall of a moving bottle, said controller is further suitable for controlling the laser radiation device so that laser radiation emitted by the laser radiation device can be directed to the other end of the label and is of sufficient power so as to weld the other end of the label over the first end of the label.

2. The apparatus according to claim 1, wherein the application unit comprises a radiation deflecting device which changes an impingement region where radiation from the radiation device impinges on the label.

3. The apparatus according to claim 1, wherein the apparatus further comprises a guide device for guiding a cut label for application to the bottles.

4. The apparatus according to claim 1, wherein the cutting unit comprises a radiation device for cutting the label strips.

5. The apparatus according to claim 1, wherein the cutting unit comprises a rotatable roller for guiding the label strip, wherein the rotatable roller has fixing elements for fixing the label strip at least temporarily to a circumferential wall of the roller.

6. The apparatus according to claim 1, wherein the application unit is arranged immediately downstream of the cutting unit.

7. An application unit for applying labels directly to bottles, comprising a carrier device, on which a plurality of support elements for the bottles are arranged, wherein the support elements are moveable by the carrier device along a predefined path, and wherein the support elements are rotatable relative to the carrier device, wherein the application unit comprises a laser radiation device and a controller for the laser radiation device which is suitable for controlling power and direction of the laser radiation emitted by the laser radiation device along a first radiation path for welding a first section of a label directly to a bottle, and which is further suitable for controlling power and direction of the laser radiation emitted by the laser radiation device along a second radiation path for welding a second section of the label to the first section of the label.

8. The apparatus according to claim 7, wherein the application unit comprises a radiation deflecting device which changes an impingement region where radiation from the radiation device impinges on the label.

9. The apparatus according to claim 7, wherein the apparatus further comprises a guide device for guiding a cut label for application to the bottles.

10. The apparatus according to claim 7, wherein the cutting unit comprises a radiation device for cutting the label strips.

11. The apparatus according to claim 7, wherein the cutting unit comprises a rotatable roller for guiding the label strip, wherein the rotatable roller has fixing elements for fixing the label strip at least temporarily to a circumferential wall of the roller.

12. The apparatus according to claim 7, wherein the application unit is arranged immediately downstream of the cutting unit.

13. The apparatus according to claim 1, wherein the transport path of the bottles is at least in sections arranged on a horizontal level of the laser radiation device or the radiation deflecting device.

14. The apparatus according to claim 1, wherein the transport path of the bottles is at least in the section in which the labels are welded onto the bottles arranged on a horizontal level of the laser radiation device or the radiation deflecting device.

15. The apparatus according to claim 1, wherein the power of the laser radiation device is sufficient for welding labels onto the bottles.

16. The apparatus according to claim 1, wherein the power of the laser radiation device is sufficient for melting the label and/or the surface of the bottle so that molten plastics serve as adhesive for binding the label onto the bottle.

17. The apparatus according to claim 1, wherein the laser radiation device is arranged so that during the welding of the label onto the bottle only parts of the label are exposed to the radiation.

* * * * *